US006148778A

United States Patent [19]

Sturman

[11] Patent Number: 6,148,778

[45] Date of Patent: Nov. 21, 2000

[54] AIR-FUEL MODULE ADAPTED FOR AN INTERNAL COMBUSTION ENGINE

[75] Inventor: Oded E. Sturman, Woodland Park, Colo.

[73] Assignee: Sturman Industries, Inc., Woodland Park, Colo.

[21] Appl. No.: 09/078,881

[22] Filed: May 14, 1998

Related U.S. Application Data

[63] Continuation-in-part of application No. 08/899,801, Jul. 24, 1997, Pat. No. 5,960,753, which is a continuation of application No. 08/807,668, Feb. 27, 1997, Pat. No. 5,713,316, which is a continuation of application No. 08/442,665, May 17, 1995, Pat. No. 5,638,781, which is a continuation-in-part of application No. 08/838,093, Apr. 15, 1997, Pat. No. 6,012,644.

[51] Int. Cl.[7] ..... F01L 9/02

[52] U.S. Cl. ..... 123/90.12; 123/90.22; 123/315; 123/432

[58] Field of Search ..... 123/90.12, 90.13, 123/90.27, 90.22, 90.23, 308, 315, 432

[56] References Cited

U.S. PATENT DOCUMENTS

| | | |
|---|---|---|
| Re. 33,270 | 7/1990 | Beck et al. . |
| 892,191 | 6/1908 | Shuller . |
| 1,700,228 | 1/1929 | Kendall . |
| 2,144,862 | 1/1939 | Truxell, Jr. . |
| 2,421,329 | 5/1947 | Hoffer . |
| 2,434,586 | 1/1948 | Reynolds . |
| 2,535,937 | 12/1950 | Bozec et al. . |
| 2,552,445 | 5/1951 | Nielsen . |
| 2,597,952 | 5/1952 | Rosenlund . |
| 2,621,011 | 12/1952 | Smith . |
| 2,672,827 | 3/1954 | McGowen, Jr. . |
| 2,727,498 | 12/1955 | Reiners . |
| 2,749,181 | 6/1956 | Maxwell et al. . |
| 2,793,077 | 5/1957 | Bovard . |
| 2,912,010 | 11/1959 | Evans et al. . |
| 2,916,048 | 12/1959 | Gunkel . |
| 2,930,404 | 3/1960 | Kowalski et al. . |
| 2,934,090 | 4/1960 | Kenann et al. . |

(List continued on next page.)

FOREIGN PATENT DOCUMENTS

| | | |
|---|---|---|
| 0 149 598 A2 | 7/1985 | European Pat. Off. . |
| 0 184 940 A2 | 6/1986 | European Pat. Off. . |
| 0 331 198 A2 | 9/1989 | European Pat. Off. . |
| 0 375 944 A2 | 7/1990 | European Pat. Off. . |
| 0 425 236 A1 | 5/1991 | European Pat. Off. . |

(List continued on next page.)

OTHER PUBLICATIONS

North American Edition, Diesel Progress, Apr. 1997, Developments in Digital Valve Technology by Rob Wilson.

North American Edition, Diesel Progress, Aug. 1997, Vickers Taking Closer Aim at Mobile Markets, by Mike Brezonick.

"The Swing to Cleaner, Smarter Hydraulics", Industrial Management & Technology, Fortune 152[A], Jun. 1997 by Stuart Brown.

(List continued on next page.)

[57] ABSTRACT

A valve module that can be assembled to an internal combustion engine chamber. The valve module may have a first intake valve, a second intake valve, a third intake valve, a first exhaust valve and a second exhaust valve. The valves may be driven to an open position by hydraulically driven first pins. The exhaust valves may further have hydraulically driven second pins. The additional pins may increase the hydraulic forces which allow the exhaust valves to be opened even when there is a large pressure in the combustion chamber. The first pins of the exhaust valves may be controlled by a microprocessor controlled first control valve. The second pins may be controlled by a microprocessor controlled second control valve. The separate control valves and additional hydraulic force of the second pins may allow the microprocessor to open the exhaust valves at any point during a cycle of a combustion engine.

14 Claims, 4 Drawing Sheets

U.S. PATENT DOCUMENTS

| | | |
|---|---|---|
| 2,945,513 | 7/1960 | Sampeitro . |
| 2,967,545 | 1/1961 | Schmidt . |
| 2,985,378 | 5/1961 | Falberg . |
| 3,035,780 | 5/1962 | Peras . |
| 3,057,560 | 10/1962 | Campbell . |
| 3,071,714 | 1/1963 | Hadekel . |
| 3,175,771 | 3/1965 | Breting . |
| 3,209,737 | 10/1965 | Omotenara et al. ..... 123/90 |
| 3,368,791 | 2/1968 | Wells . |
| 3,391,871 | 7/1968 | Fleischer et al. . |
| 3,408,007 | 10/1968 | Raichle et al. . |
| 3,410,519 | 11/1968 | Evans . |
| 3,458,769 | 7/1969 | Stampfli . |
| 3,512,557 | 5/1970 | Weldy . |
| 3,532,121 | 10/1970 | Sturman . |
| 3,570,806 | 3/1971 | Sturman . |
| 3,570,807 | 3/1971 | Sturman . |
| 3,570,833 | 3/1971 | Sturman et al. . |
| 3,575,145 | 4/1971 | Steiger . |
| 3,585,547 | 6/1971 | Sturman . |
| 3,587,547 | 6/1971 | Hussey . |
| 3,604,959 | 9/1971 | Sturman . |
| 3,675,853 | 7/1972 | Lapera . |
| 3,683,239 | 8/1972 | Sturman . |
| 3,689,205 | 9/1972 | Links . |
| 3,718,159 | 2/1973 | Tennis . |
| 3,731,876 | 5/1973 | Showalter . |
| 3,743,898 | 7/1973 | Sturman . |
| 3,753,426 | 8/1973 | Lilley . |
| 3,753,547 | 8/1973 | Topham . |
| 3,796,205 | 3/1974 | Links et al. . |
| 3,814,376 | 6/1974 | Reinicke . |
| 3,821,967 | 7/1974 | Sturman et al. . |
| 3,827,409 | 8/1974 | O'Neill . |
| 3,835,829 | 9/1974 | Links . |
| 3,858,135 | 12/1974 | Gray . |
| 3,868,939 | 3/1975 | Friese et al. . |
| 3,921,604 | 11/1975 | Links . |
| 3,921,901 | 11/1975 | Woodman . |
| 3,989,066 | 11/1976 | Sturman et al. . |
| 3,995,652 | 12/1976 | Belart et al. . |
| 4,009,695 | 3/1977 | Ule . |
| 4,046,112 | 9/1977 | Deckard . |
| 4,064,855 | 12/1977 | Johnson . |
| 4,065,096 | 12/1977 | Frantz et al. . |
| 4,069,800 | 1/1978 | Kanda et al. . |
| 4,077,376 | 3/1978 | Thoma . |
| 4,080,942 | 3/1978 | Vincent et al. . |
| 4,083,498 | 4/1978 | Cavanagh et al. . |
| 4,087,736 | 5/1978 | Mori et al. . |
| 4,087,773 | 5/1978 | Jencks et al. . |
| 4,107,546 | 8/1978 | Sturman et al. . |
| 4,108,419 | 8/1978 | Sturman et al. . |
| 4,114,647 | 9/1978 | Sturman et al. . |
| 4,114,648 | 9/1978 | Nakajima et al. . |
| 4,120,456 | 10/1978 | Kimura et al. . |
| 4,152,676 | 5/1979 | Morgenthaler et al. . |
| 4,165,762 | 8/1979 | Acar . |
| 4,182,492 | 1/1980 | Albert et al. . |
| 4,189,816 | 2/1980 | Chalansonnet . |
| 4,192,466 | 3/1980 | Tanasawa elt al. . |
| 4,217,862 | 8/1980 | Fort et al. . |
| 4,219,154 | 8/1980 | Luscomb . |
| 4,221,192 | 9/1980 | Badgley . |
| 4,231,525 | 11/1980 | Palma . |
| 4,243,876 | 1/1981 | Boukamp et al. . |
| 4,248,270 | 2/1981 | Ostrowski . |
| 4,260,333 | 4/1981 | Schillinger . |
| 4,266,727 | 5/1981 | Happel et al. . |
| 4,271,807 | 6/1981 | Links et al. . |
| 4,273,291 | 6/1981 | Muller . |
| 4,275,693 | 6/1981 | Leckie . |
| 4,279,385 | 7/1981 | Straubel et al. . |
| 4,308,891 | 1/1982 | Loup . |
| 4,319,609 | 3/1982 | Debrus . |
| 4,329,951 | 5/1982 | Seilly . |
| 4,342,443 | 8/1982 | Wakeman . |
| 4,346,681 | 8/1982 | Schleicher et al. . |
| 4,354,662 | 10/1982 | Thompson . |
| 4,372,272 | 2/1983 | Walter et al. . |
| 4,375,274 | 3/1983 | Thoma et al. . |
| 4,378,775 | 4/1983 | Straubel et al. . |
| 4,381,750 | 5/1983 | Funada . |
| 4,392,612 | 7/1983 | Deckard et al. . |
| 4,396,037 | 8/1983 | Wilcox . |
| 4,396,151 | 8/1983 | Kato et al. . |
| 4,405,082 | 9/1983 | Walter et al. . |
| 4,409,638 | 10/1983 | Sturman et al. . |
| 4,413,600 | 11/1983 | Yamagawa et al. . |
| 4,414,940 | 11/1983 | Loyd . |
| 4,422,424 | 12/1983 | Luscomb . |
| 4,425,894 | 1/1984 | Kato et al. . |
| 4,437,443 | 3/1984 | Hofbauer . |
| 4,440,132 | 4/1984 | Terada et al. . |
| 4,440,134 | 4/1984 | Nakao et al. . |
| 4,448,169 | 5/1984 | Badgley et al. . |
| 4,449,507 | 5/1984 | Mayer . |
| 4,457,282 | 7/1984 | Muramatsu et al. . |
| 4,459,959 | 7/1984 | Terada et al. . |
| 4,462,368 | 7/1984 | Funada . |
| 4,480,619 | 11/1984 | Igashira et al. . |
| 4,482,094 | 11/1984 | Knape . |
| 4,501,290 | 2/1985 | Sturman et al. . |
| 4,506,833 | 3/1985 | Yoneda et al. . |
| 4,516,600 | 5/1985 | Sturman et al. . |
| 4,518,147 | 5/1985 | Andresen et al. . |
| 4,526,145 | 7/1985 | Honma et al. . |
| 4,526,519 | 7/1985 | Mowbray et al. . |
| 4,527,738 | 7/1985 | Martin . |
| 4,540,126 | 9/1985 | Yoneda et al. . |
| 4,541,387 | 9/1985 | Morikawa . |
| 4,541,390 | 9/1985 | Steinbrenner et al. . |
| 4,541,454 | 9/1985 | Sturman et al. . |
| 4,550,875 | 11/1985 | Teerman et al. . |
| 4,554,896 | 11/1985 | Sougawa . |
| 4,557,685 | 12/1985 | Gellert . |
| 4,558,844 | 12/1985 | Donahue, Jr. . |
| 4,568,021 | 2/1986 | Deckard et al. . |
| 4,572,132 | 2/1986 | Piwonka . |
| 4,599,983 | 7/1986 | Omachi . |
| 4,603,671 | 8/1986 | Yoshinaga et al. . |
| 4,604,675 | 8/1986 | Pflederer . |
| 4,605,166 | 8/1986 | Kelly . |
| 4,610,428 | 9/1986 | Fox . |
| 4,611,632 | 9/1986 | Kolchinsky et al. . |
| 4,619,239 | 10/1986 | Wallenfang et al. . |
| 4,625,918 | 12/1986 | Funada et al. . |
| 4,627,571 | 12/1986 | Kato et al. . |
| 4,628,881 | 12/1986 | Beck et al. . |
| 4,648,580 | 3/1987 | Kuwano et al. . |
| 4,653,455 | 3/1987 | Eblen et al. . |
| 4,658,824 | 4/1987 | Scheibe . |
| 4,669,429 | 6/1987 | Nishida et al. . |
| 4,681,143 | 7/1987 | Sato et al. . |
| 4,684,067 | 8/1987 | Cotter et al. . |
| 4,699,103 | 10/1987 | Tsukahara et al. . |
| 4,702,212 | 10/1987 | Best et al. . |
| 4,715,541 | 12/1987 | Fruedenschuss et al. . |
| 4,719,885 | 1/1988 | Nagano et al. . |
| 4,721,253 | 1/1988 | Noguchi et al. . |
| 4,726,389 | 2/1988 | Minoura et al. . |
| 4,728,074 | 3/1988 | Igashira et al. . |

4,741,365 5/1988 Van Ornum .
4,741,478 5/1988 Teerman et al. .
4,753,416 6/1988 Inagaki et al. .
4,770,346 9/1988 Kaczynski .
4,785,787 11/1988 Riszk et al. .
4,787,412 11/1988 Wigmore et al. .
4,794,890 1/1989 Richeson, Jr. .
4,798,186 1/1989 Ganser .
4,807,812 2/1989 Renowden et al. .
4,811,221 3/1989 Sturman et al. .
4,812,884 3/1989 Mohler .
4,813,599 3/1989 Greiner et al. .
4,821,773 4/1989 Herion et al. .
4,825,842 5/1989 Steiger .
4,826,080 5/1989 Ganser .
4,831,989 5/1989 Haines .
4,838,230 6/1989 Matsuoka .
4,838,310 6/1989 Scott et al. .
4,841,936 6/1989 Takahashi .
4,846,440 7/1989 Carlson et al. .
4,869,218 9/1989 Fehlmann et al. .
4,869,429 9/1989 Brooks et al. .
4,870,939 10/1989 Ishikawa et al. .
4,875,499 10/1989 Fox .
4,877,187 10/1989 Daly .
4,884,545 12/1989 Mathis .
4,884,546 12/1989 Sogawa .
4,887,562 12/1989 Wakeman ..... 123/90.12
4,893,102 1/1990 Bauer .
4,893,652 1/1990 Nogle et al. .
4,905,120 2/1990 Grembowicz et al. .
4,909,440 3/1990 Mitsuyasu et al. .
4,922,878 5/1990 Shinogle et al. .
4,928,887 5/1990 Miettaux .
4,930,464 6/1990 Letsche ..... 123/90.12
4,955,334 9/1990 Kawamura .
4,957,084 9/1990 Sverdlin .
4,964,571 10/1990 Taue et al. .
4,974,495 12/1990 Richeson, Jr. .
4,979,674 12/1990 Taira et al. .
4,993,637 2/1991 Kanesaka .
5,004,577 4/1991 Ward .
5,016,820 5/1991 Gaskell .
5,036,885 8/1991 Miura .
5,037,031 8/1991 Campbell et al. .
5,042,445 8/1991 Peters et al. .
5,048,488 9/1991 Bronkal .
5,049,971 9/1991 Krumm .
5,050,543 9/1991 Kawamua .
5,050,569 9/1991 Beunk et al. .
5,054,458 10/1991 Wechem et al. .
5,056,488 10/1991 Eckert .
5,067,658 11/1991 De Matthaeis et al. .
5,069,189 12/1991 Saito .
5,076,236 12/1991 Yu et al. .
5,085,193 2/1992 Morikawa .
5,092,039 3/1992 Gaskell .
5,094,215 3/1992 Gustafson .
5,108,070 4/1992 Tominaga .
5,110,087 5/1992 Studtmann et al. .
5,121,730 6/1992 Ausman et al. .
5,125,807 6/1992 Kohler et al. .
5,131,624 7/1992 Kreuter et al. .
5,133,386 7/1992 Magee .
5,143,291 9/1992 Grinsteiner .
5,156,132 10/1992 Iwanaga .
5,161,779 11/1992 Graner et al. .
5,168,855 12/1992 Stone .
5,176,115 1/1993 Campion .
5,178,359 1/1993 Stobbs et al. .
5,181,494 1/1993 Ausman et al. .
5,188,336 2/1993 Graner et al. .
5,191,867 3/1993 Glassey .
5,207,201 5/1993 Schlagmuller et al. .
5,213,083 5/1993 Glassey .
5,219,122 6/1993 Iwanaga .
5,230,317 7/1993 Nonogawa et al. ..... 123/432
5,237,968 8/1993 Miller et al. .
5,237,976 8/1993 Lawrence et al. .
5,244,002 9/1993 Frederick .
5,245,970 9/1993 Iwaszkiewicz et al. .
5,249,603 10/1993 Byers, Jr. .
5,251,659 10/1993 Sturman et al. .
5,251,671 10/1993 Hiroki .
5,255,641 10/1993 Schecter ..... 123/90.11
5,261,366 11/1993 Regueiro .
5,261,374 11/1993 Gronenberg et al. .
5,269,269 12/1993 Kreuter .
5,271,371 12/1993 Meints et al. .
5,287,829 2/1994 Rose .
5,287,838 2/1994 Wells .
5,293,551 3/1994 Perkins et al. .
5,297,523 3/1994 Hafner et al. .
5,313,924 5/1994 Regueiro .
5,325,834 7/1994 Ballheimer et al. .
5,339,777 8/1994 Cannon ..... 123/90.12
5,345,916 9/1994 Amann et al. .
5,346,673 9/1994 Althausen et al. .
5,357,912 10/1994 Barnes et al. .
5,375,576 12/1994 Ausman et al. .
5,410,994 5/1995 Schechter .
5,423,302 6/1995 Glassey .
5,423,484 6/1995 Zuo .
5,429,309 7/1995 Stockner .
5,445,129 8/1995 Barnes .
5,447,138 9/1995 Barnes .
5,448,973 9/1995 Meyer ..... 123/90.12
5,450,329 9/1995 Sturman .
5,463,996 11/1995 Maley et al. .
5,477,828 12/1995 Barnes .
5,478,045 12/1995 Ausman et al. .
5,479,901 1/1996 Gibson et al. .
5,485,957 1/1996 Sturman .
5,487,368 1/1996 Bruning .
5,487,508 1/1996 Zuo .
5,492,098 2/1996 Hafner et al. .
5,492,099 2/1996 Maddock .
5,499,606 3/1996 Robnett et al. ..... 123/90.12
5,499,608 3/1996 Meister et al. .
5,499,609 3/1996 Evans et al. .
5,499,612 3/1996 Haughney et al. .
5,505,384 4/1996 Camplin .
5,509,391 4/1996 DeGroot .
5,515,829 5/1996 Wear et al. .
5,522,545 6/1996 Camplin et al. .
5,529,044 6/1996 Barnes et al. .
5,535,723 7/1996 Gibson et al. .
5,572,961 11/1996 Schechter et al. ..... 123/90.12
5,577,892 11/1996 Schittler et al. .
5,595,148 1/1997 Letsche et al. ..... 123/90.1
5,597,118 1/1997 Carter, Jr. et al. .
5,598,871 2/1997 Sturman et al. .
5,622,152 4/1997 Ishida .
5,638,781 6/1997 Sturman .
5,640,987 6/1997 Sturman .
5,641,148 6/1997 Pena et al. .
5,669,355 9/1997 Gibson et al. .
5,713,316 2/1998 Sturman .

FOREIGN PATENT DOCUMENTS 0 245 373 B1 3/1992 European Pat. Off. .
0 751 285 1/1997 European Pat. Off. .
2 209 206 8/1973 Germany .
40 29 510 A1 3/1991 Germany .

| | | |
|---|---|---|
| 41 18 236 A1 | 12/1991 | Germany . |
| 44 01 073 A1 | 7/1995 | Germany . |
| 195 23 337 A1 | 1/1996 | Germany . |
| 4-341653 | 11/1992 | Japan . |
| 981665 | 12/1982 | Russian Federation . |
| 264710 | 10/1949 | Switzerland . |
| 892121 | 3/1962 | United Kingdom . |
| WO 95/27865 | 10/1995 | WIPO . |
| WO 96/07820 | 3/1996 | WIPO . |
| WO 96/08656 | 3/1996 | WIPO . |
| WO 96/17167 | 6/1996 | WIPO . |
| WO 97/02423 | 1/1997 | WIPO . |
| WO 98/46876 | 10/1998 | WIPO . |

OTHER PUBLICATIONS

Electronic Unit Injectors—Revised, G. Frankl, G.G. Barker and C.T Timms, Copyright 1989 Society of Automotive Engineers, Inc.

SAE Technical Paper Series, Benefits of New Fuel Injection System Technology on Cold Startability of Diesel Engines—Improvement of Cold Startability and White Smoke Reduction by Means of Multi Injection with Common Rail Fuel System (ECD–U2), Isao Osuka et al., Feb. 28–Mar. 3, 1994.

SAE Technical Paper Series, Development of the HEUI Fuel System—Integration of Design, Simulation, Test and Manufacturing, A.R. Stockner, et al., Mar. 1–5, 1993.

SAE Technical Paper Series, "HEUI—A New Direction for Diesel Engine Fuel System," S.F. Glassey et al., Mar. 1–5, 1993.

Machine Design, Feb. 21, 1994, "Breakthrough in Digital Valves," Carol Sturman, Eddit Sturman.

Patent Specification No. 349, 65, "Improved Electro–magnetic Double–acting Balanced Valve," Joseph Leslie Musgrave et al.

Patent Specification No. 1 465 283, Improvements in Fuel Injectors for Internal Combustion Engines, Seiji Suda et al., published Feb. 23, 1977.

Sturman Industries Gets Innovative All the Way!, The Bugle, Apr. 1993, vol. 19, Issue 4.

SuperFlow News, vol. 13, Spring 1998, "Sturman Tests Revolutionary Fuel Injectors".

*Primary Examiner*—Weilun Lo
*Attorney, Agent, or Firm*—Blakely, Sokoloff, Taylor & Zafman LLP

AIR-FUEL MODULE ADAPTED FOR AN INTERNAL COMBUSTION ENGINE

CROSS-REFERENCE TO RELATED APPLICATIONS

This application is a continuation-in-part of U.S. application Ser. No. 08/899,801, filed Jul. 24, 1997, now U.S. Pat. No. 5,960,753, which is a continuation of U.S. application Ser. No. 08/807,668, filed Feb. 27, 1997, now U.S. Pat. No. 5,713,316 which is a continuation of U.S. application Ser. No. 08/442,665, filed May 17, 1995, now U.S. Pat. No. 5,638,781 and is also a continuation-in-part of U.S. application Ser. No. 08/838,093, filed Apr. 15, 1997, now U.S. Pat. No. 6,012,644.

BACKGROUND OF THE INVENTION

1. Field of the Invention

The present invention relates to a camless valve module adapted for an internal combustion engine.

2. Background Information

Compression ignition internal combustion engines contain one or more reciprocating pistons located within respective combustion chambers of an engine block. Associated with each piston is a fuel injector that sprays a highly pressurized fuel into the combustion chamber. The fuel is mixed with air that is introduced into the combustion chamber through one or more intake valves. After combustion, the exhaust gas flows out of the combustion chamber through one or more exhaust valves. The injection of fuel and movement of the intake and exhaust valves are typically controlled by mechanical cams. Valve cams are relatively inefficient and susceptible to wear. Additionally, the cams do not allow the engine to vary the timing of fuel injection, or the opening and closing of the intake/exhaust valves independent of engine speed.

U.S. Pat. No. 5,255,641 issued to Schechter and assigned to Ford Motor Co. and U.S. Pat. No. 5,339,777 issued to Cannon and assigned to Caterpillar Inc. disclose hydraulically driven intake/exhaust valves that do not require cams to open and close the valves. The movement of the intake/exhaust valves are controlled by a solenoid actuated fluid valve(s). When the fluid valve(s) is in one position, a hydraulic fluid flows into an enclosed stem portion of the intake/exhaust valve. The hydraulic fluid exerts a force on the stem which opens the valve. When the fluid valve(s) is switched to another position, the intake/exhaust valve moves back to its original closed position. The fluid valve(s) is switched by an electronic controller. The controller can vary the timing of the intake/exhaust valves to optimize the performance of the engine.

The solenoid actuated fluid valves are typically connected to a single microprocessor which can vary the valve timing in response to variations in a number of input parameters such as fuel intake, hydraulic rail pressure, ambient temperature, etc. The microprocessor can vary the start time and the duration of the driving signal provided to the fluid valves to obtain a desired result. Because of variations in manufacturing tolerances, different valves may have different responses to the same driving pulse. For example, given the same driving pulse, one intake valve may open for a shorter period of time than another intake valve in the same engine.

The Schechter patent discusses a process wherein each valve is calibrated to determine a correction value. The correction value is stored within the electronics of the engine and used to either shorten or lengthen the driving pulse provided to each valve so that each of the valves are open for the same time duration. Although effective in compensating for variations in manufacturing tolerances, the Schechter technique does not compensate for variations that occur during the life of the engine. For example, one of the valves may begin to stick and require more energy to move into an open position.

The camless intake valve(s) is typically actuated by a dedicated control valve which can either open or close the valve. The intake valve orifice area is the same each time the intake valve(s) is open. Likewise, the exhaust valve(s) may be controlled by a dedicated control valve such that the valve orifice area is the same each time the valve(s) is open. It may be desirable to vary the orifice area and the corresponding flow of air and exhaust gases to and from the combustion chamber. Such a configuration would provide another variable that can be used by the microcontroller to optimize the fuel consumption, power, emissions, etc. of the engine.

Some internal combustion engines contain a "turbocharger" which pushes air into the combustion chambers. Turbochargers are typically driven by the flow of exhaust gases from the combustion chamber. The pressures within a combustion chamber are very high particularly at a piston top dead center position. Opening the exhaust valves at such high pressures typically requires a large amount of work. Consequently, the exhaust valves are typically not opened until the piston has moved toward a bottom dead center position. At this position, the exhaust gas pressure is relatively low. The low exhaust gas pressure may not be as effective in driving the turbocharger as a higher exhaust gas pressure. It would be desirable to provide a valve assembly which would allow the exhaust valves to be opened at any time during a cycle of an engine.

SUMMARY OF THE INVENTION

One embodiment of the present invention is a valve assembly adapted for an internal combustion engine chamber. The valve assembly may include a first control valve and a second control valve that control a first exhaust valve and a second exhaust valve.

DETAILED DESCRIPTION OF THE INVENTION

One embodiment of the present invention may be a valve module that can be assembled to an internal combustion engine chamber. The valve module may have a first intake valve, a second intake valve, a third intake valve, a first exhaust valve and a second exhaust valve. The valves may be driven to an open position by hydraulically driven first pins. The exhaust valves may further have hydraulically driven second pins. The additional pins may increase the hydraulic forces which allow the exhaust valves to be opened even when there is a large pressure in the combustion chamber. The first pins of the exhaust valves may be controlled by a microprocessor controlled first control valve. The second pins may be controlled by a microprocessor controlled second control valve. The separate control valves and additional hydraulic force of the second pins may allow the microprocessor to open the exhaust valves at any point during a cycle of a combustion engine.

The first and second intake valves may be controlled by a microprocessor controlled first control valve. The third intake valve may be controlled by a microprocessor controlled second control valve. The control valves may be actuated so that different combinations of intake valves are opened to allow a microprocessor to vary the orifice opening area of the intake valves and the flowrate of air into the combustion chamber.

Figure 1:
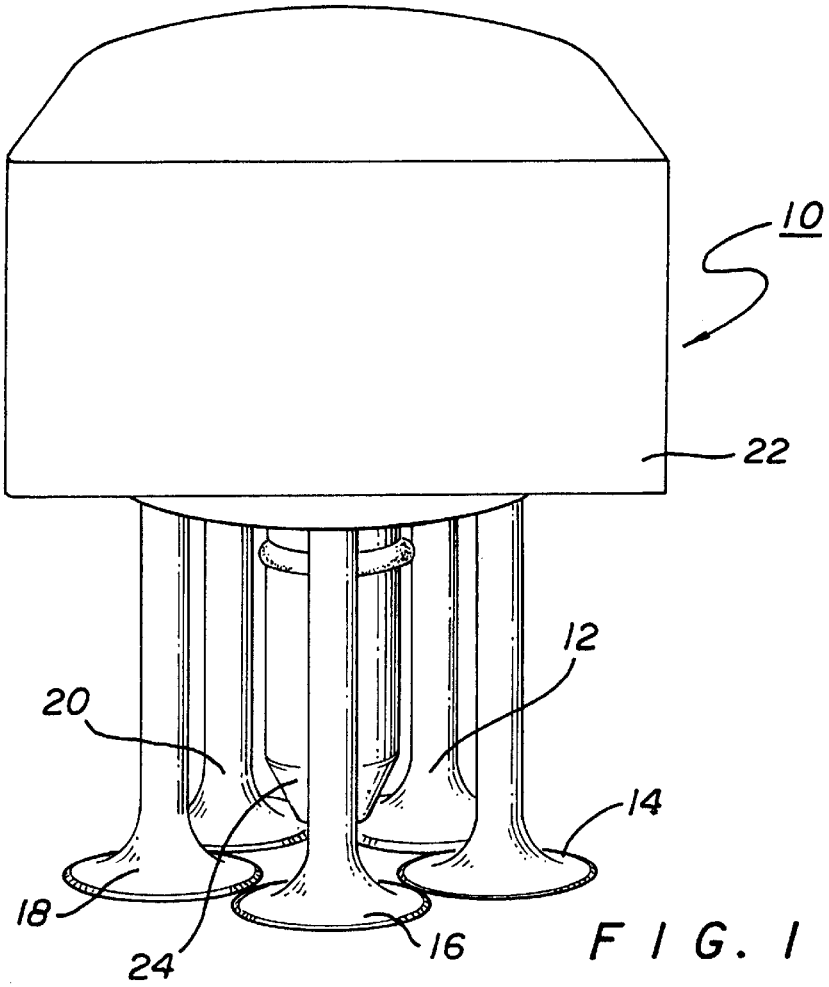
FIG. 1 is a side view of a valve module of the present invention.

Referring to the drawings more particularly by reference numbers, FIG. 1 shows an embodiment of a valve module 10 of the present invention. The module 10 may include a first intake valve 12, a second intake valve 14 and a third intake valve 16. The module 10 may also contain a first exhaust valve 18 and a second exhaust valve 20. The valves 12, 14, 16, 18 and 20 may extend from a module housing 22 in an arrangement which surrounds a fuel injector 24.

Figure 2:
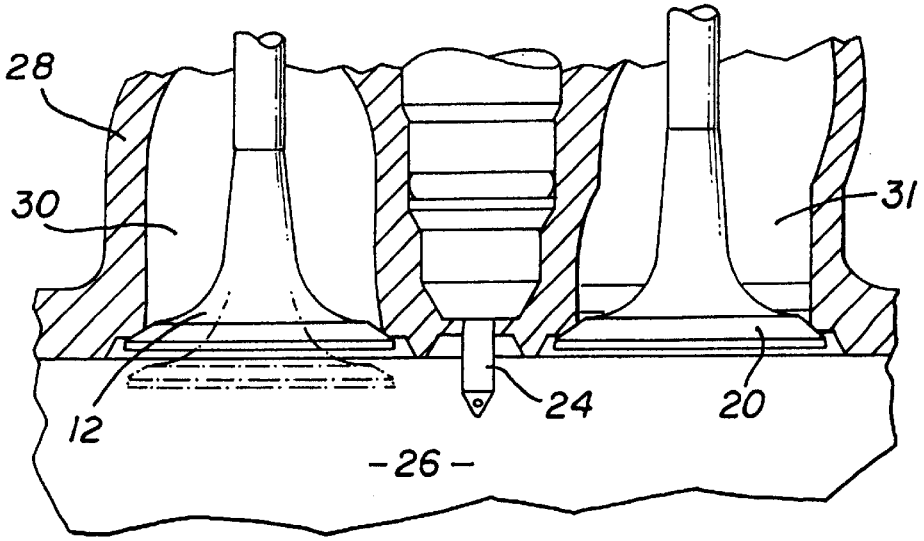
FIG. 2 is a partial side cross-sectional view showing valves of the module within an internal combustion engine chamber.

As shown in FIG. 2, the module 10 may be assembled to a single internal combustion engine chamber 26 of an engine cylinder head 28. It being understood that an engine typically contains one or more combustion chambers 26, wherein there may be a module 10 associated with each combustion chamber 26. Intake valve 12 is located within an intake opening 30 of the cylinder head 28. Exhaust valve 20 is located within an exhaust opening 31. Although not shown, valves 14, 16 and 18 may also be located within corresponding openings (not shown) of the cylinder head 28.

The intake valves 12, 14, 16 may each move between an open position and a closed position. Air may flow into the combustion chamber 26 when one or more of the intake valves 12, 14 and/or 16 are in their open positions. Likewise, the exhaust valves 18 and 20 may each move between an open position and a closed position. Exhaust gases may flow out of the combustion chamber 26 when one or more of the valves 18 and 20 are in their open positions.

Figure 3:
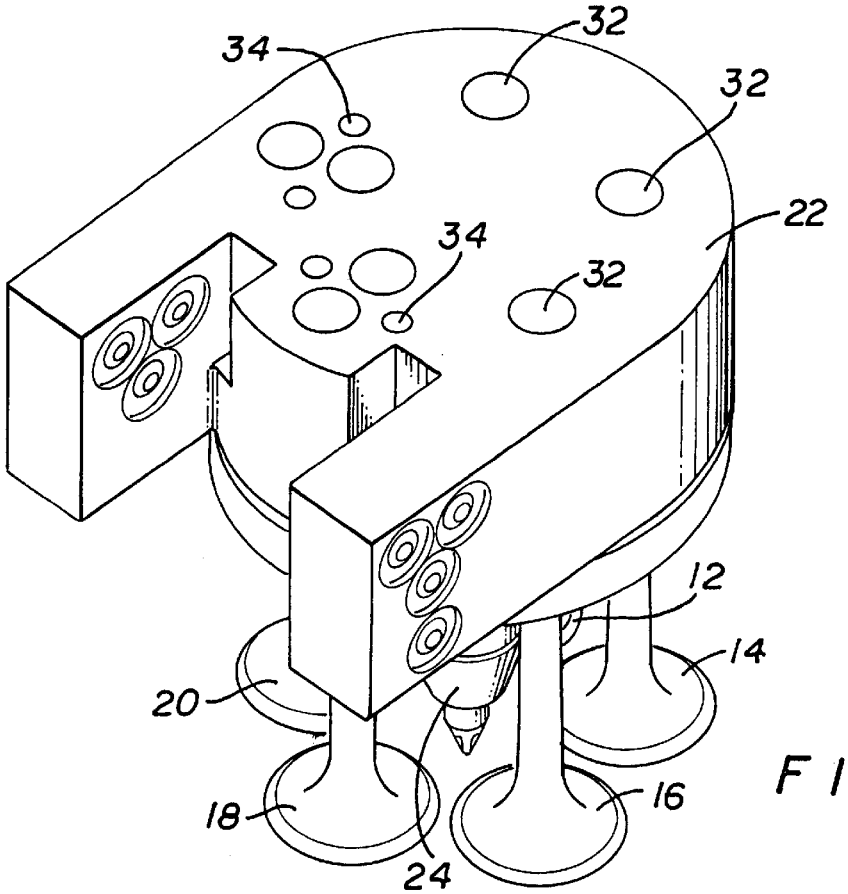
FIG. 3 is a top perspective view of the module.
Figure 4:
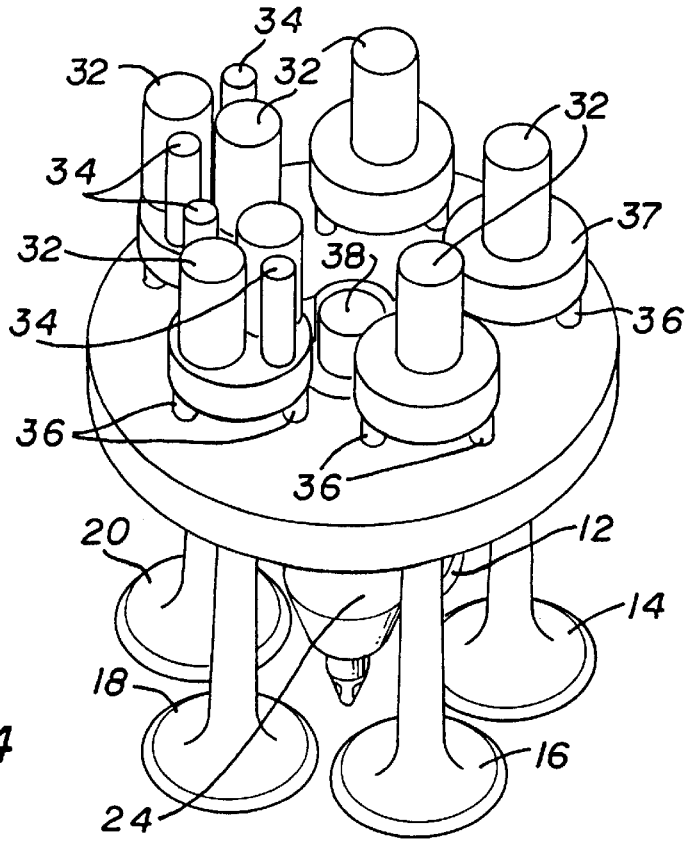
FIG. 4 is a top perspective view showing a plurality of hydraulically driven pins of the module.

FIGS. 3 and 4 show a plurality of hydraulically driven first pins 32 that move the valves 12, 14, 16, 18 and 20 to their open positions. The exhaust valves 18 and 20 may each also have a pair of hydraulically driven second pins 34 that assist in moving the valves 18 and 20 to their open position. The second pins 34 provide additional hydraulic forces to open the exhaust valves 18 and 20 even when there exists a relatively high exhaust gas pressure within the combustion chamber 26. By way of example, the first pins 32 may each have a diameter of about 0.4 inch (mm), the second pins 34 may each have diameter of about 0.2 inch (mm).

The module 10 may contain a plurality of hydraulically driven third pins 36 which move the valves 12, 14, 16, 18 and 20 to their closed positions. The valves 12, 14, 16, 18 and 20 may each have a head 37 coupled to the pins 32, 34 and 36.

Also shown is an intensifier 38 of the fuel injector 24. The intensifier 38 may be hydraulically driven to eject fuel into the combustion chamber 26. The pins 32, 34, 36 and intensifier 38 may be arranged in fluid communication with various fluid lines and fluid chambers (not shown) of the module housing 22. A control fluid may flow within the lines and chambers to exert hydraulic forces on the pins 32, 34, 36 and the intensifier 38. The control fluid may be the fuel of the engine or a separate hydraulic fluid such as engine lubrication oil.

Figure 5:
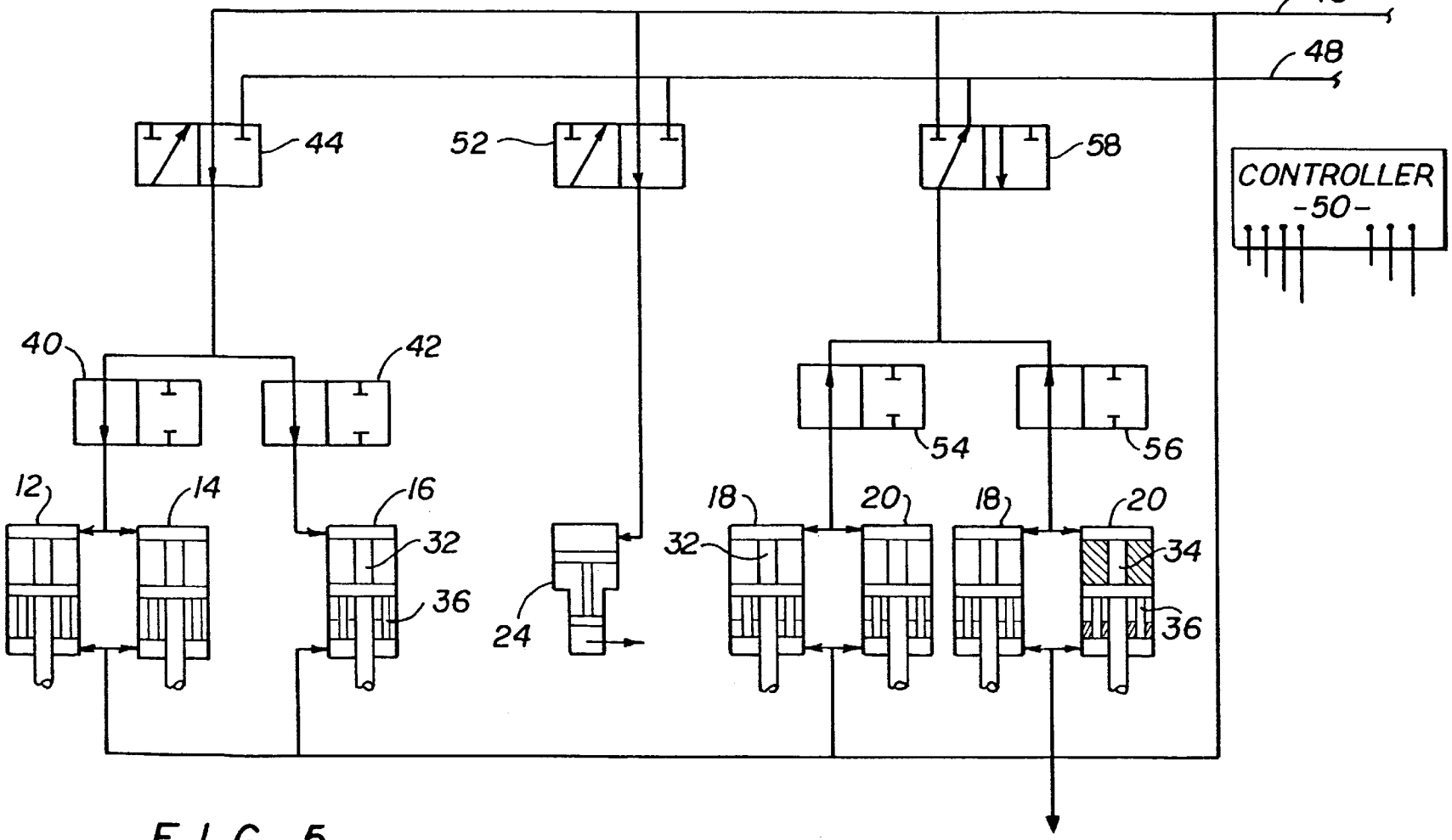
FIG. 5 is an hydraulic schematic of the module.

FIG. 5 shows an hydraulic system which controls the flow of control fluid which drives the pins 32, 34 and 36 to open and close the valves 12, 14, 16, 18 and 20. The system may include a first intake control valve 40 which is hydraulically coupled to the first pins 32 to control the opening of the first 12 and second 14 intake valves 12, 14. The third intake valve 16 may be controlled by a second intake control valve 42. The first 40 and second 42 control valves may be two-way valves. The first 40 and second 42 control valves may be connected to a third intake control valve 44.

The third control valve 44 may be a three-way normally-open valve that is connected to a high pressure rail line 46 and a low pressure drain line 48. The rail line 46 is typically connected to the output of a pump (not shown). The drain line 48 may be connected to a low pressure reservoir of control fluid. The control valves 40, 42 and 44 may be selectively actuated into one of two positions. In one position, the third control valve 44 connects the control valves 40 and 42 to the rail line 46 and isolates the control valves 40, 42 from the drain line 48. In the other position, the third control valve 44 connects the control valves 40 and 42 to the drain line 48 and isolates the control valves 40, 42 from the rail line 46.

In one position, the first 40 and second 42 control valves are arranged in fluid communication with the first pins 32 of the intake valves 12, 14 and 16 to the output of the third control valve 44 to allow fluid to flow from the rail line 46, or to the drain line 48 depending upon the selected state of the third valve 44. In the other valve position, the control valves 40 and 42 prevent fluid flow to or from the first pins 32.

The third pins 36 may be connected directly to the rail line 46. The effective area of the third pins 36 may be smaller than the effective area of the first pins 32 so that valves 12, 14 and 16 are moved into the open positions when the pins 32 are hydraulically coupled to the rail line 46. The fluid pressure within the rail line 46 exerts hydraulic forces on the third pins 36 to move the valves 12, 14 and 16 to their closed position when the first pins 32 are hydraulically coupled to the drain line 48.

The control valves 40, 42 and 44 may be electrically connected to an electronic controller 50. The controller 50 may provide electrical signals which selectively switch the position of the valves 40, 42 and 44. Although not shown, the valves 40, 42 and 44 may each contain a spool that is located between a pair of electrical coils. Providing electrical current to one of the coils will move the spool to one position. Providing electrical current to the other coil will move the spool to its other position. The spool and valve housing 22 may be constructed from a material which has enough residual magnetism to maintain the position of the spool even when electrical current is not being provided to at least one of the coils. By way of example, the material may be 4140 steel. The control valves 40, 42 and 44 may be similar to the valves disclosed in U.S. Pat. No. 5,640,987 issued to Sturman, which is hereby incorporated by reference.

In operation, the third control valve 44 may be switched to a state to couple the control valves 40 and 42 to the rail line 46. Both control valves 40 and 42 may be switched to a state which allows control fluid to flow to the first pins 32 and open the first 12, second 14 and third 16 intake valves. Alternatively, the control valves 40 and 42 may be switched so that only the first 12 and second 14 exhaust valves are opened. As another alternate mode the control valves 40 and 42 may be switched so that only the third intake valve 16 is opened.

The system thus provides different combinations of air intake valves which can be opened, to vary the orifice area and the flowrate of air into the combustion chamber 26. The flowrate of air can be varied by the controller 50 to optimize the operation of the engine in accordance with an algorithm which also utilizes different input values such as engine speed, temperature, ambient pressure, etc. The valves 12, 14 and 16 may have the same or different seat diameters to further vary the effective orifice area lending into the combustion chamber 26.

The control valves 40 and 42 may also be actuated to lock the position of the intake valves 12, 14 and 16 by being switched into a position which prevents fluid flow from or to the first pins 32. This allows the valves 12, 14 and 16 to be locked into an intermediate open position between a fully open position and a fully closed position. The valves 12, 14 and 16 can be moved back to their closed positions by switching the control valves 40, 42 and 44 so that the first pins 32 are hydraulically coupled to the drain line 48. The control valves 40, 42 and 44 can also allow the processor 50 to modulate the position of the valves 12, 14 and 16 relative to the intake openings to further modify or modulate the air flowrate into the combustion chamber 26.

The module 10 may include an injector control valve 52 that is connected to the rail line 46, the drain line 48 and the fuel injector 24. In one position, the control valve 52 hydraulically couples the fuel injector 24 to the rail line 46 so that fuel is ejected into the combustion chamber 26. The control valve 52 can then be switched to hydraulically couple the fuel injector 24 to the drain line 48 which causes fuel to be drawn into the injector 24.

The system may include a first exhaust control valve 54 which controls the actuation of the first pins 32 of the exhaust valves 18 and 20, and a second exhaust control valve 56 which controls the actuation of the second pins 34. The first 54 and second 56 control valves may be connected to a third exhaust control valve 58. The third control valve 58 may be selectively connected to either the rail line 46 or the drain lines 48. The first 54 and second 56 control valves may each be two-way valves. The third control valve 58 may be a three-way valve. The control valves 54, 56 and 58 may be similar to the valves disclosed in the above '987 patent.

The third pins 36 of the exhaust valves 18 and 20 may be connected directly to the rail line 46 and have an effective area smaller than the effective area of the first pins 32 so that the exhaust valves 18 and 20 are moved to their open position when the pins 32 are hydraulically coupled to the rail line 46. The control valves 54, 56 and 58 may operate the opening and closing of the exhaust valves 18 and 20 in a manner similar to the operation of the intake valves 12, 14 and 16.

The control valves 54, 56 and 58 may be electrically connected to the controller 50. The controller 50 may actuate the control valves 54 and 58 so that the first pins 32 are hydraulically coupled to the rail line 46 and isolated from the drain line 48. Consequently, the exhaust valves 18 and 20 are moved by the first pins 32 to an open position. The control valve 54 may be switched to lock the positions of the valves 18 and 20. The exhaust valves 18 and 20 may be moved to their closed positions by switching the control valves 54 and 58 so that the first pins 32 are hydraulically coupled to the drain line 48 and isolated from the rail line 46.

The control valves 54, 56 and 58 may be actuated so that the first 32 and second 34 pins are both hydraulically coupled to the rail line 46 to push open the exhaust valves 18 and 20. The controller 50 can thus actuate the control valves 54 and 56 to provide an additional hydraulic force through pins 34 to open the exhaust valves 18 and 20. This allows the controller 50 to open the exhaust valves 18 and 20 even when there is a relatively high exhaust gas pressure in the combustion chamber 26. The high exhaust gas pressure can be provided to a turbocharger downstream from the exhaust opening 31 of the combustion chamber 26.

Figure 6:
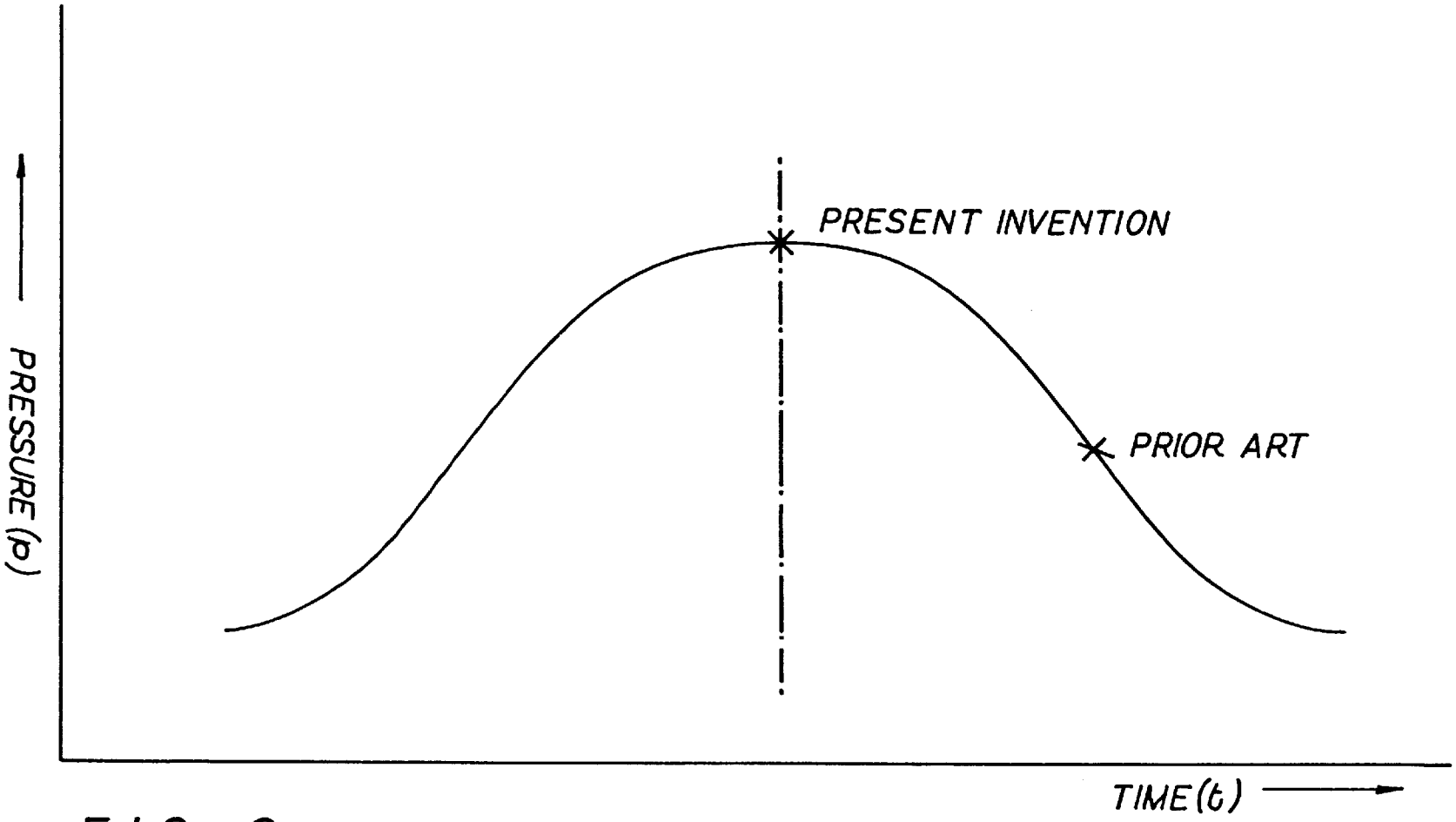
FIG. 6 is a graph showing the location of the exhaust valve opening on an exhaust gas pressure versus time curve.

FIG. 6 shows a typical pressure versus time curve for the internal combustion engine 26. In prior art systems, the exhaust valves are typically opened at a relatively low exhaust pressure. With the system of the present invention, the exhaust valves may be opened at anytime during the engine cycle, including a time when the combustion chamber 26 has maximum exhaust gas pressure. The available high exhaust gas pressure communicated from the combustion chamber 26 through the opened exhaust valve(s) may more effectively drive a turbocharger of the engine.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A valve assembly adapted for a single internal combustion engine chamber that has a rail line and a drain line, comprising:

a first exhaust valve adapted to be coupled to the internal combustion engine chamber;

a second exhaust valve adapted to be coupled to the internal combustion engine chamber;

a first control valve operable to control and couple said first and second exhaust valves with the rail line or the drain line; and, a second control valve operable to control said first and second exhaust valves.

2. The valve assembly of claim 1, wherein said first and second exhaust valves are each hydraulically driven by a first pin and a second pin, respectively.

3. The valve assembly of claim 2, wherein said first and second exhaust valves are each drivable by a respective third pin.

4. The valve assembly of claim 1, further comprising a third control valve connected to said first and second control valves.

5. The valve assembly of claim 4, wherein said first and second control valves are two-way valves and said third control valve is a three-way valve.

6. The valve assembly of claim 5, further comprising an electronic controller operable to control said first, second and third control valves.

7. A valve module adapted for a single internal combustion engine chamber, comprising:

a first intake valve adapted to be coupled to the internal combustion engine chamber;

a second intake valve adapted to be coupled to the internal combustion engine chamber;

a first intake control valve operable to control said first and second intake valves;

a third intake valve adapted to be coupled to the internal combustion engine chamber;

a second intake control valve operable to control said third intake valve;

a first exhaust valve adapted to be coupled to the internal combustion engine chamber;

a second exhaust valve adapted to be coupled to the internal combustion engine chamber;

a first exhaust control valve operable to control said first and second exhaust valves; and, a second exhaust control valve operable to control said first and second exhaust valves.

8. The valve module of claim 7, wherein said first and second exhaust valves are each hydraulically drivable by a first pin and a second pin, respectively.

9. The valve module of claim 8, wherein said first and second exhaust valves are each drivable by a respective third pin.

10. The valve module of claim 9, further comprising a third intake control valve that is connected to said first and second intake control valves, and a third exhaust control valve that is connected to said first and second exhaust control valves.

11. A valve assembly adapted for a single internal combustion engine chamber that has a rail line and a drain line, the valve assembly comprising:

a first intake valve adapted to be coupled to the internal combustion engine chamber;

a first control valve operable to control and couple said first intake valve with the rail line or the drain line;

a second intake valve adapted to be coupled to the internal combustion engine chamber;

a second control valve operable to control said second intake valve; and, a third control valve that is connected to said first and second control valves.

12. The valve assembly of claim 11, wherein said first and second control valves are two-way valves and said third control valve is a three-way valve.

13. The valve assembly of claim 11, further comprising an electronic controller operable to control said first, second and third control valves.

14. A valve assembly adapted for a single internal combustion engine chamber that has a rail line and a drain line, the valve assembly comprising:

a first intake valve adapted to be coupled to the internal combustion engine chamber;

a first control valve operable to control and couple said first intake valve with the rail line or the drain line;

a second intake valve adapted to be coupled to the internal combustion engine chamber;

a second control valve operable to control said second intake valve;

a third intake valve that is adapted to be coupled to the internal combustion chamber and is controllable by said first control valve; and, said first and second intake valves each drivable by a respective third pin.

* * * * *

UNITED STATES PATENT AND TRADEMARK OFFICE

CERTIFICATE OF CORRECTION

PATENT NO. : 6,148,778
DATED : November 21, 2000
INVENTOR(S) : Sturman

It is certified that error appears in the above-identified patent and that said Letters Patent is hereby corrected as shown below:

Title page,

Item [63], Related U.S. Application Data, please delete "which is a continuation-in-part of application No. 08/838,093, Apr. 15, 1997, Pat. No. 6,012,644" and insert -- and is also a continuation-in-part of application No. 08/838,093, Apr. 15, 1997, Pat. No. 6,012,644 --.

Item [56], under References Cited, U.S. PATENT DOCUMENTS, please delete "4,243,876 1/1981 Boukamp et al." and insert -- 4,246,876 1/1981 Bouwkamp --.

In reference "4,957,084", please delete "Sverdlin" and insert -- Kramer et al. --.

After reference "4,957,084", please insert -- 4,957,805 9/1990 Sverdlin --.

In reference "5,050,543", please delete "Kawamua" and insert -- Kawamura --.

In reference "5,255,641", please delete "Schecter" and insert -- Schechter --.

FOREIGN PATENT DOCUMENTS, please insert -- 2 308 175 B 9/1998 United Kingdom --.

OTHER PUBLICATIONS, please delete "No. 349, 65" and insert -- 349,165 --.

Column 5,

Line 1, please delete "exhaust" and insert -- intake --.

Line 13, please delete "lending" and insert -- leading --.

Signed and Sealed this

Sixteenth Day of July, 2002

*Attest:*

*Attesting Officer*

JAMES E. ROGAN
*Director of the United States Patent and Trademark Office*